US010022291B2

(12) United States Patent
Jackson et al.

(10) Patent No.: US 10,022,291 B2
(45) Date of Patent: Jul. 17, 2018

(54) SENSORY FURNITURE SYSTEM FOR TREATMENTS, METHOD OF USE, AND METHOD OF MANUFACTURE

(71) Applicant: The Sensory Chair Company, Inc., Overland Park, KS (US)

(72) Inventors: Stuart T. Jackson, Overland Park, KS (US); Keith E. Manbeck, Gardner, KS (US)

(73) Assignee: The Sensory Chair Company, Inc., Overland Park, KS (US)

( * ) Notice: Subject to any disclaimer, the term of this patent is extended or adjusted under 35 U.S.C. 154(b) by 176 days.

(21) Appl. No.: 14/816,907

(22) Filed: Aug. 3, 2015

(65) Prior Publication Data

US 2016/0158089 A1 Jun. 9, 2016

Related U.S. Application Data

(60) Provisional application No. 62/087,553, filed on Dec. 4, 2014.

(51) Int. Cl.

| | |
|---|---|
| ***A61H 9/00*** | (2006.01) |
| ***A47C 27/08*** | (2006.01) |
| ***A47C 7/02*** | (2006.01) |

(52) U.S. Cl.

CPC ..... *A61H 9/0078* (2013.01); *A47C 7/024* (2013.01); *A47C 27/082* (2013.01); (Continued)

(58) Field of Classification Search

CPC .. A61H 9/0078; A47C 27/082; A47C 27/083; A47C 7/024

See application file for complete search history.

(56) References Cited

U.S. PATENT DOCUMENTS

| | | | |
|---|---|---|---|
| 2,053,538 | A | 8/1935 | Scott et al. |
| 3,148,391 | A | 9/1964 | Whitney |

(Continued)

FOREIGN PATENT DOCUMENTS

| | | |
|---|---|---|
| WO | 4714434 | 12/1987 |
| WO | WO2014120084 | 8/2014 |

OTHER PUBLICATIONS

"International Search Report & Written Opinion; PCT/US2017/017976, dated Jun. 3, 2017".

*Primary Examiner* — Mohammad Ali
*Assistant Examiner* — Vincent Chang
(74) *Attorney, Agent, or Firm* — Law Office of Mark Brown, LLC; Christopher M. DeBacker

(57) ABSTRACT

A sensory lounging chair system and method of use. The system generally includes a frame, a pump, air tubes connecting the pump to a pair of inflatable air tubes, pressure release valves, piping and hardware, a pressure sensor, and a fabric cover. In a preferred embodiment, the pump and pressure sensor are powered by a power supply connected to a terminal board, which in turn is connected to the pump and the pressure sensor. The fabric cover provides a comfortable barrier between the occupant and the air tubes, which initially are usually deflated or less than fully inflated. As the pressure in the air tubes increase, deep touch pressure is applied to the occupant's body in the places where the air tubes are in contact with the occupant. Deep touch pressure is thus applied to the occupant via contact with the tubes through the fabric cover.

9 Claims, 5 Drawing Sheets

(52) U.S. Cl.
CPC .... *A47C 27/083* (2013.01); *A61H 2201/0149* (2013.01); *A61H 2201/1238* (2013.01); *A61H 2201/1633* (2013.01); *A61H 2201/5071* (2013.01)

(56) References Cited

U.S. PATENT DOCUMENTS

| | | | | |
|---|---|---|---|---|
| 3,712,674 | A | 1/1973 | Ando | |
| 4,540,177 | A | 9/1985 | Horvath | |
| 4,593,907 | A | 6/1986 | Abu-Shumays et al. | |
| 4,667,961 | A | 5/1987 | Abu-Shumays et al. | |
| 4,714,434 | A | 12/1987 | Norden | |
| 4,840,425 | A | 6/1989 | Noble | |
| 5,149,172 | A | 9/1992 | Davis | |
| 5,566,941 | A | 10/1996 | Destics | |
| 5,636,900 | A | 6/1997 | Wilkie et al. | |
| 5,658,050 | A | 8/1997 | Lorbiecki | |
| 5,699,570 | A | 12/1997 | Wilkinson | |
| 5,797,155 | A | 8/1998 | Maier et al. | |
| 5,826,871 | A | 10/1998 | Li | |
| 5,836,854 | A | 11/1998 | Kuo | |
| 5,848,982 | A | 12/1998 | Hoshino et al. | |
| 5,992,850 | A | 11/1999 | Li | |
| 6,171,270 | B1 | 1/2001 | Gau | |
| 6,179,383 | B1 | 1/2001 | Ochi | |
| 6,237,914 | B1 | 5/2001 | Saltanov et al. | |
| 6,857,632 | B2 | 2/2005 | Tanner | |
| 7,261,380 | B2 | 8/2007 | Ha | |
| 7,264,601 | B2 | 9/2007 | Liao | |
| 7,717,869 | B2 * | 5/2010 | Eischen, Sr. ..... | A43B 23/029 601/152 |
| D660,919 | S | 5/2012 | Perrin | |
| 8,827,371 | B2 | 9/2014 | Brncick et al. | |
| 2006/0258964 | A1 | 11/2006 | Biondo et al. | |
| 2008/0071200 | A1 | 3/2008 | Rawl-Meehan | |
| 2009/0127783 | A1 | 5/2009 | Paquette | |
| 2009/0177130 | A1 * | 7/2009 | Wegher-Thompson | A61M 21/02 601/151 |
| 2010/0145245 | A1 | 6/2010 | Chen | |
| 2010/0137764 | A1 | 7/2010 | Eddy | |
| 2010/0198120 | A1 * | 8/2010 | Tago ..... | A61H 1/0237 601/134 |
| 2010/0198121 | A1 | 8/2010 | Tago et al. | |
| 2013/0231596 | A1 | 9/2013 | Hornbach et al. | |
| 2013/0284274 | A1 * | 10/2013 | Chaffee ..... | G05D 16/208 137/14 |
| 2014/0031609 | A1 | 1/2014 | Ballard | |
| 2014/0109319 | A1 | 4/2014 | Wilkinson | |
| 2014/0167463 | A1 | 7/2014 | Sakata et al. | |
| 2014/0346833 | A1 | 11/2014 | Magda et al. | |
| 2015/0040326 | A1 | 2/2015 | Fairburn et al. | |
| 2016/0158089 | A1 | 6/2016 | Jackson et al. | |
| 2016/0158090 | A1 * | 6/2016 | Jackson ..... | A61H 9/0078 601/134 |
| 2016/0199248 | A1 | 7/2016 | Jackson et al. | |
| 2017/0000685 | A1 | 1/2017 | Rohr et al. | |

* cited by examiner

SENSORY FURNITURE SYSTEM FOR TREATMENTS, METHOD OF USE, AND METHOD OF MANUFACTURE

CROSS-REFERENCE TO RELATED APPLICATION

This application claims priority in U.S. Provisional Patent Application No. 62/087,553 filed Dec. 4, 2014, which is incorporated herein by reference.

BACKGROUND OF THE INVENTION

1. Field of the Invention

The present invention relates generally to sensory furniture, and more specifically to a sensory lounging chair for use in the treatment of neurodevelopmental disorders such as sensory processing disorder, autism, and other neurological, neuropsychological and physical conditions, and the method to manufacture and use the same.

2. Description of the Related Art

Deep touch pressure is a form of tactile sensory input, often provided by firm holding, firm stroking, hugging, swaddling, and squeezing. A non-invasive and easily applied therapeutic method, deep touch pressure generally provides a calming effect for the recipient. A growing body of literature shows that deep touch pressure is helpful for managing anxiety and reducing maladaptive behaviors in people with cognitive developmental disorders, sensory processing disorder, psychological disorders, and certain other neurological and physical conditions. Research also shows that deep touch pressure can improve the quality of life for people experience anxiety, pain and unrest.

Several devices have been designed and developed to provide continuous deep touch pressure. Such devices include weighted blankets, therapy vests, and other sensory-based interventions which provide relatively low amounts of pressure. In the past, deep touch pressure machines have been developed to provide pressure to persons exhibiting oversensitivity to human touch. One such machine developed by Krauss (1987) was designed as having two air mattresses surrounded by a canvas wrap which was connected to a pulley. A person would lie between the two mattresses and pull on the rope connected to the pulley to increase the pressure exerted on him. Krauss, Am. 1. Occup. Ther., *The effects of deep pressure on anxiety,* 41:366-373 (1987). Another such machine that has been widely used is the squeeze machine developed by Temple Grandin. The squeeze machine provided increased pressure compared to the Krauss device. The squeeze machine included two padded side boards hinged at the bottom to form a "V" shape, similar to a cattle squeeze chute. A lever-operated pneumatic valve is connected to an air cylinder that pulls the boards together. The lever allows the user to regulate the amount of pressure applied. While these devices accomplish the task of providing deep touch pressure, there remains a need for an aesthetically pleasing, practical, lightweight, quiet device that provides variable deep touch pressure consistent with the needs of a user.

What is needed is a system for providing sensory pressure to a person in a comfortable manner. The system should be adaptable to persons of varying shapes and sizes.

Heretofore there has not been available a sensory treatment device with the advantages and features of the present invention.

SUMMARY OF THE INVENTION

The present invention generally provides a sensory lounging chair system and method of use. The system generally includes a frame, a pump, air tubes connecting the pump to a pair of inflatable air tubes, pressure release valves, piping and hardware, a pressure sensor, and a fabric cover.

In a preferred embodiment, called the Sensory Lounger, the pump and pressure sensor are powered by a power supply connected to a terminal board, which in turn is connected to the pump and the pressure sensor. An on/off switch controls the electrical current to the system. When this is switched on and the pressure release valve is in the closed position, the pump will start to inflate the tubes. The tubes will continue to inflate until the pressure sensor reaches a certain upper pre-set limit, at which point the pump will switch off. An optional check valve can be inserted into the system to maintain the pressure, however, the most common configuration is to not include the check valve and allow the system to slowly deflate. This continues until a lower pre-set limit is reached, at which point, the pump switches back on and the system inflates until it once again reaches the upper pre-set pressure limit and the pump switches back off. The pre-set pressure range (the difference between the upper and lower preset limits) is usually around 0.1 psi, but can be adjusted according to an occupant's preferences. To quickly deflate the air tubes, the release valve is switched to the open position.

When an occupant first lays in the Sensory Lounger, the fabric cover provides a comfortable barrier between the occupant and the air tubes, which initially are usually deflated or less than fully inflated. With the pressure release valve in the closed position and the pump switched on, the air tubes begin to inflate around the occupant, conforming to the occupant's body. As the pressure in the air tubes increase, deep touch pressure is applied to the occupant's body in the places where the air tubes are in contact with the occupant. When the pressure in the tubes reaches the upper pre-set limit, the pump switches off. If the occupant shifts position such that the pressure in the tubes drops below the lower pre-set limit, the pump switches back on until the pressure once again reaches the upper pre-set limit. Deep touch pressure is thus applied to the occupant via contact with the tubes through the fabric cover. The level of deep touch pressure is maintained through the pressure sensor between the pre-set pressure range, but can be quickly released by opening the pressure release valve. Different levels of deep touch pressure can be achieved by adjusting the pre-set upper and lower pressure limits on the pressure sensor, or by making course pressure adjustments by opening and closing the pressure release valve.

A alternative embodiment mechanical version of the pump and pressure sensor system may be provided by replacing the electrical powered pump with a mechanical pump such as a bellows foot pump or hand pump, and by replacing the pressure sensor with a pressure limiting valve, with an adjustable set-point. This set-point is set to a pressure point similar to the upper pre-set limit in the electrical version of this system. In the mechanical version the mechanical pump is used to inflate the tubes, and the pressure can be increased until it reaches the set-point of the pressure limiting valve

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
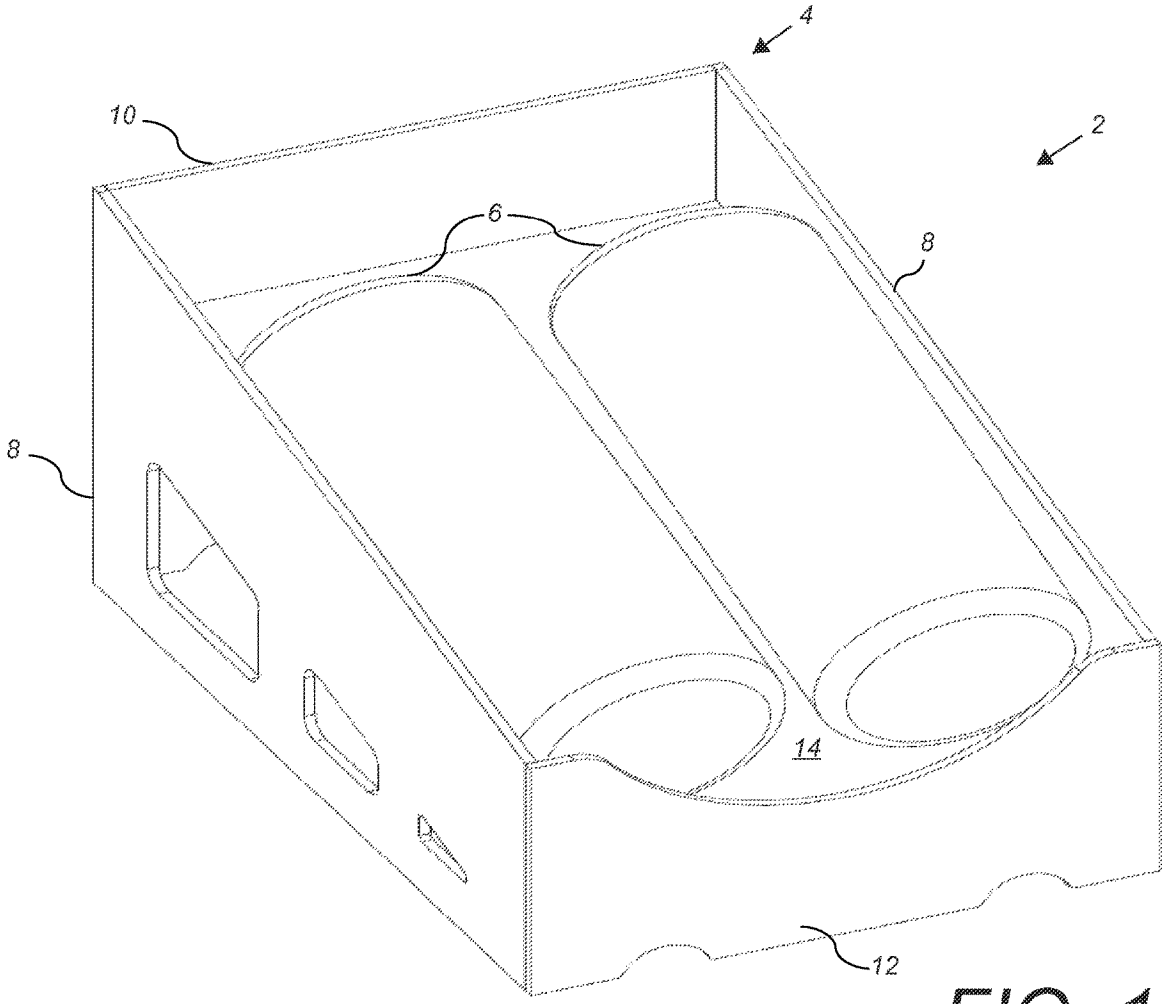
FIG. 1 is an isometric view of a preferred embodiment of the present invention in a fully assembled state.
Figure 2:
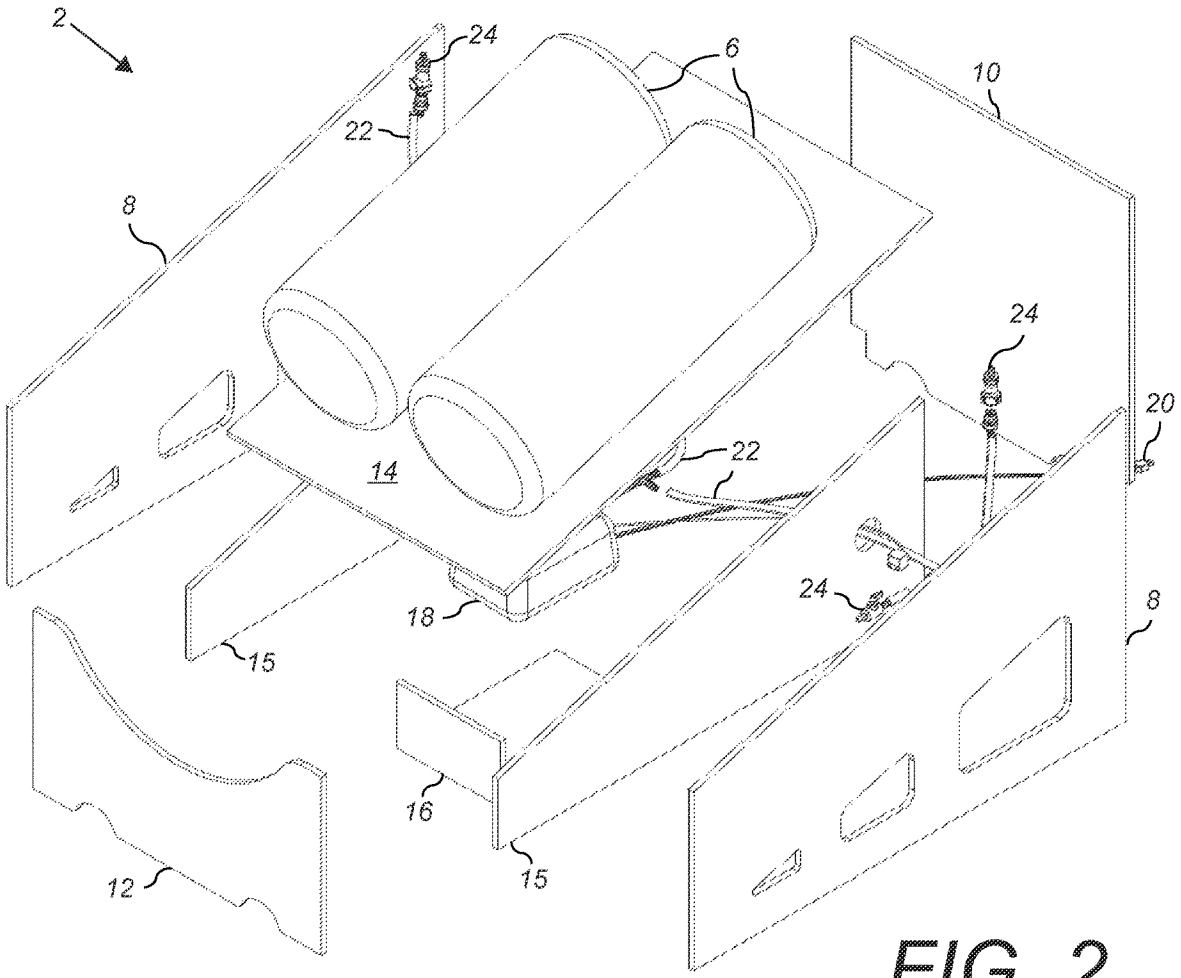
FIG. 2 is an isometric exploded view thereof.
Figure 3:
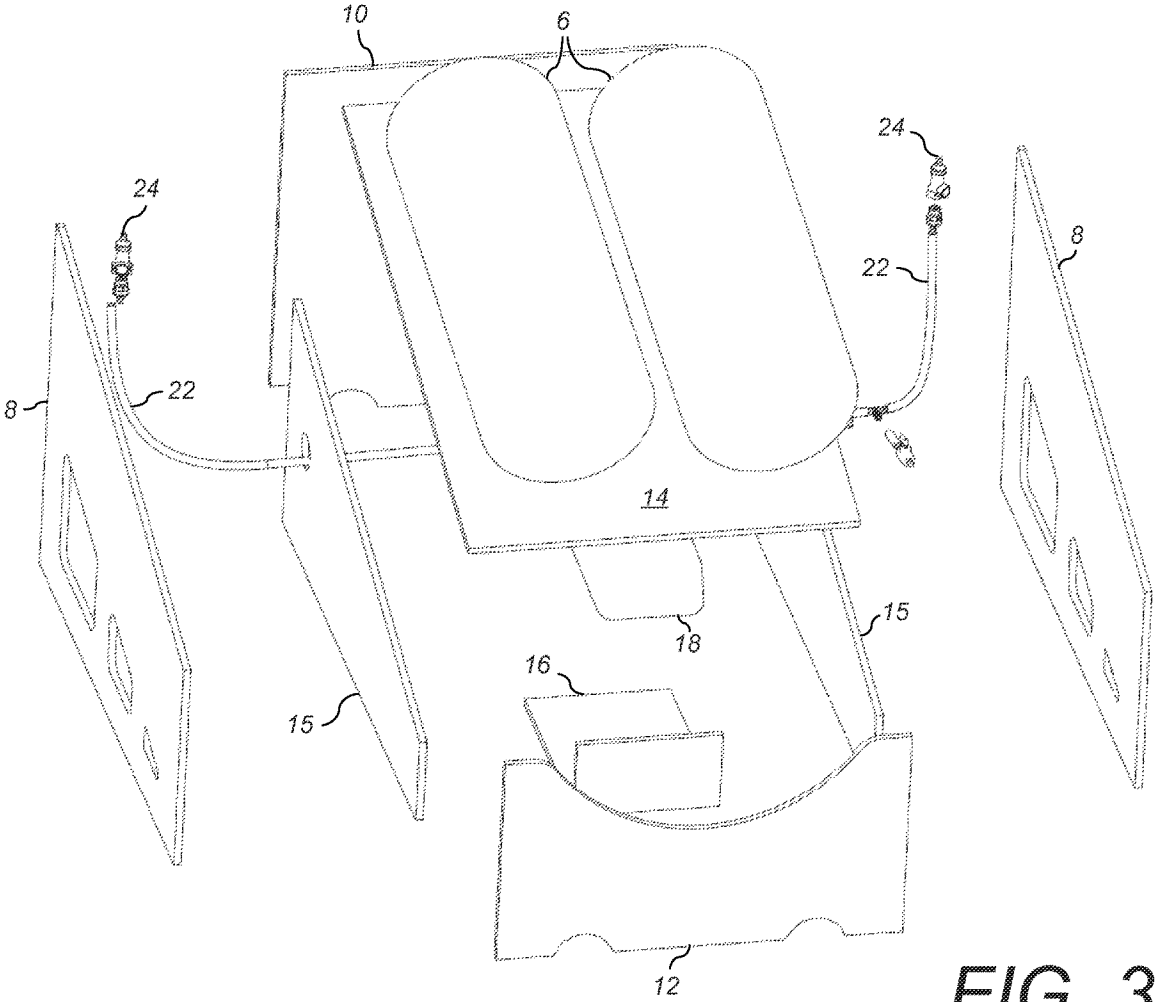
FIG. 3 is another isometric exploded view thereof.
Figure 4:
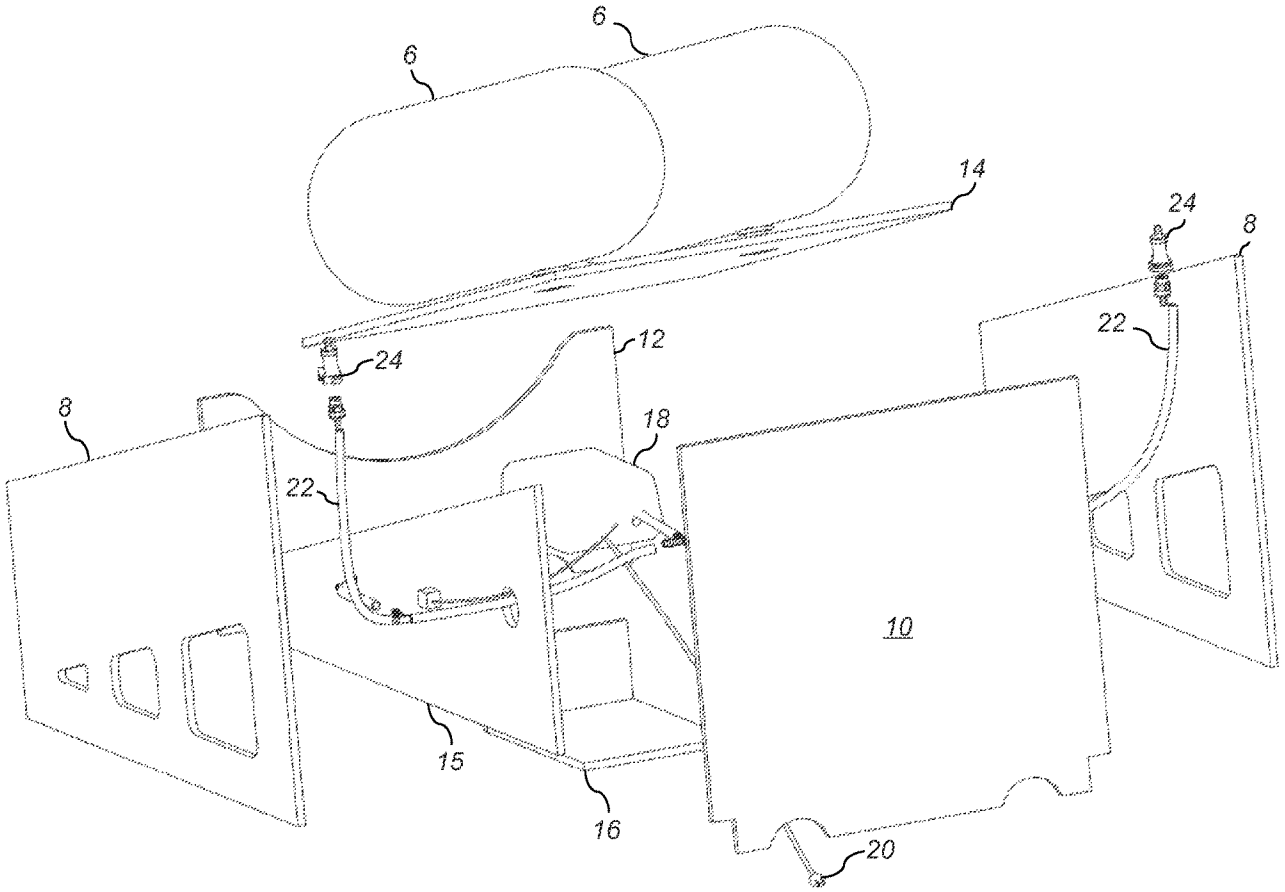
FIG. 4 is yet another isometric exploded view thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Sensory Lounger 2

As shown in the Figures, the present invention is a sensory lounger chair 2 which generally includes a box frame 4 constructed from at least a pair of elongated side walls 8, a rear wall 10, a front wall 12, and a base platform 14. A pair of air tubes 6 are set upon the base platform 14. Structural braces 15 and cover 16 enclose a pump 18. The pump is connected to the air tubes 6 via air hoses 22. Apertures located in the base platform 14 allow the hoses 22 to connect directly to the air tubes 6.

Figure 5:
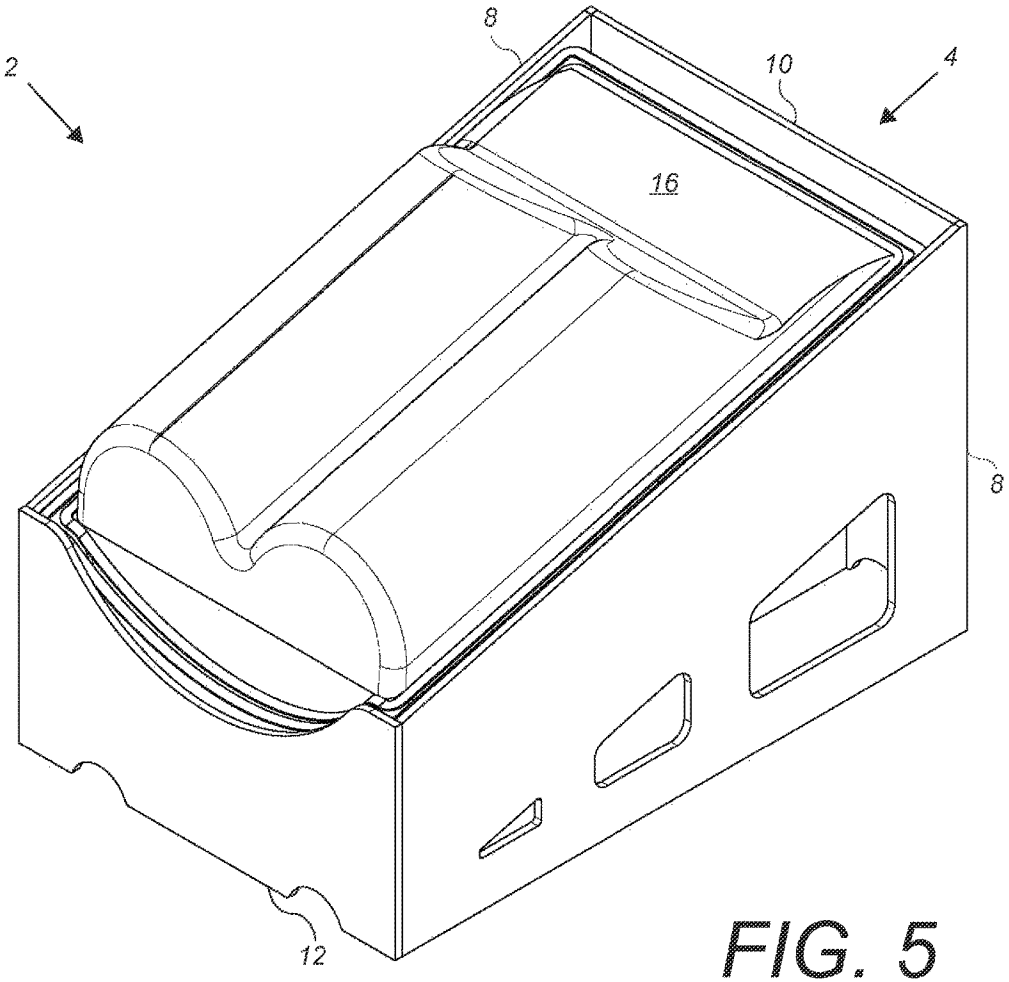
FIG. 5 is an isometric view thereof including a fabric cover.

The hoses include connectors 24 for connecting or disconnecting from the air tubes as necessary. The connectors preferably include a bleed valve and an inlet valve to control the flow of air into and out of the air tubes 6. A power cord 20 provides electrical power to the air pump 18. The pump and hoses are enclosed within the box frame 4 and structural elements. A cover (seen in FIG. 5) made of a flexible material covers the air tubes. This cover must be made of a user-friendly fabric that is removable and washable. Zippers, press studs, elasticated material or other connecting elements may alternatively be used to secure the cover to the box frame 4. The cover will flex to accommodate the air tubes as they inflate.

The pump and pressure sensor system preferably is operated using a set of controls on a control box attached to the box frame 4. Alternatively the pump and pressure sensor system can be controlled via a remote control, either wired to the control box or operated wirelessly.

The sensory lounger 2 is used by placing the occupant between the air tubes and then inflating the air tubes such that they provide sufficient pressure to the occupant. The gentle pressure effect applied by the inflated air tubes stimulates and calms the occupant. The effect is based upon the application of generalized pressure across large portions of the occupant's body.

A alternative embodiment mechanical version of the pump and pressure sensor system may be provided by replacing the electrical powered pump with a mechanical pump such as a bellows foot pump or hand pump, and by replacing the pressure sensor with a pressure limiting valve, with an adjustable set-point. This set-point is set to a pressure point similar to the upper pre-set limit in the electrical version of this system. In the mechanical version the mechanical pump is used to inflate the tubes, and the pressure can be increased until it reaches the set-point of the pressure limiting valve.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A sensory lounger chair system comprising:

a rectangular frame comprising two side boards, a front board, and a rear board, wherein the two side boards are longer than said front board and said rear board;

a base platform placed within said rectangular frame;

a pair of inflatable air tubes placed within said rectangular frame and on top of said base platform, each of said inflatable air tubes comprising a top end and a bottom end, and said inflatable air tubes oriented such that each respective air tube top end is close to said rear board and each respective air tube bottom end is adjacent to said front board;

an air pump located beneath said base platform;

at least two air hoses connected to said air pump, wherein each of said pair of inflatable air tubes is connected to at least one of said at least two air hoses, such that each air tube is connected to at least one air hose;

a pressure sensor configured to regulate and report the air pressure of said air tubes;

a pressure limiting valve connected to said air tubes, said pressure limiting valve configured to limit the maximum air pressure contained within said air tubes;

said pair of inflatable tubes being cylindrical and placed into said rectangular frame in a horizontal orientation thereby forming a lounger body for receiving a body;

a cover placed over said pair of inflatable tubes and said base platform, said cover form-fitted to receive said cylindrical inflatable tubes and further configured to transfer said air pressure of said air tubes to said body placed between said pair of air tubes;

said body having a front portion and a back portion, wherein a space having a top opening is formed between said tubes; and wherein said tubes are configured such that said body is capable being positioned in a first position within said space whereby deep touch pressure is applied to said body by said air tubes about a first area of said body located about said front portion, and wherein said body is repositioned between said tubes such that deep touch pressure is applied to a second area of said body about said back portion, and wherein said first area and said second area are distinctly separate portions of said body.

2. The system of claim 1 further comprising:

each of said at least two air hoses comprising respective connectors; and each of said connectors including a bleed valve and an inlet valve.

3. The system of claim 1, wherein said air pump comprises a pump selected from the list comprising: an electrical powered pump, a bellows foot pump, and a hand pump.

4. The system of claim 1, further comprising:

a control box connected to said air pump and to said pressure sensor;

said control box including controls configured to inflate said air tubes; and said control box further including controls configured to deflate said air tubes.

5. The system of claim 4, wherein said control box further includes controls configured to set a maximum pressure of said air tubes.

6. The system of claim 1, wherein said cover comprises a soft, flexible material.

7. A method of operating a piece of sensory furniture, the method comprising the steps:

connecting a pair of inflatable air tubes placed within a rectangular frame to an air pump with at least two air hoses, each of said pair of inflatable tubes connected to at least one of said two air hoses respectively;

activating said air pump with a controller;

detecting the pressure of said pair of air tubes with a pressure sensor and regulating a first time said pressure based upon a preconfigured setting;

placing a body at least partially within a space between said air tubes in a first position;

applying deep touch pressure to a first area of said body corresponding with a front side of said body;

regulating a second time said pressure of said pair of air tubes to maintain said preconfigured setting;

repositioning said body within said space in a second position;

providing deep touch pressure to a second area of said body corresponding with a back side of said body, wherein said first area and said second area are distinctly separate portions of said body; and regulating a third time said pressure of said pair of air tubes to maintain said preconfigured setting.

8. The method of claim 7, wherein:

said rectangular frame comprising two side boards, a front board, and a rear board, wherein the two side boards are longer than said front board and said rear board;

each of said inflatable air tubes comprising a top end and a bottom end, and said inflatable air tubes oriented such that each respective air tube top end is close to said rear board and each respective air tube bottom end is adjacent to said front board;

said air pump located beneath a base platform; and said pair of inflatable tubes placed atop said base platform.

9. The method of claim 7, further comprising the step of treating a neurological ailment with said pressure provided by said pair of air tubes.

* * * * *